US007278244B1

(12) United States Patent
Rubio

(10) Patent No.: US 7,278,244 B1
(45) Date of Patent: Oct. 9, 2007

(54) CONCRETE STUD WALL SYSTEM

(76) Inventor: Edward Rubio, 100 Cromwell Ct., Raleigh, NC (US) 27614

( * ) Notice: Subject to any disclaimer, the term of this patent is extended or adjusted under 35 U.S.C. 154(b) by 265 days.

(21) Appl. No.: 10/908,846

(22) Filed: May 27, 2005

(51) Int. Cl.
*E04B 5/04* (2006.01)

(52) U.S. Cl. ..... 52/600; 52/351; 52/355; 52/601; 52/414; 52/356; 52/367; 52/359; 52/454

(58) Field of Classification Search ..... 52/351, 52/355, 414, 600, 601, 356, 367, 359, 454
See application file for complete search history.

(56) References Cited

U.S. PATENT DOCUMENTS 3,802,147 A * 4/1974 O'Konski ..... 52/630
4,602,467 A 7/1986 Schilger ..... 52/319
4,674,723 A * 6/1987 Bayuk ..... 248/246
4,885,884 A 12/1989 Schilger ..... 52/354
5,414,972 A * 5/1995 Ruiz et al. ..... 52/600
5,482,395 A * 1/1996 Gasparini ..... 403/384
6,151,858 A 11/2000 Ruiz et al. ..... 52/481.1

* cited by examiner

*Primary Examiner*—Jeanette Chapman
*Assistant Examiner*—Dan Kenny
(74) *Attorney, Agent, or Firm*—Ishman Law Firm, P.C.

(57) ABSTRACT

A concrete stud wall system includes elongated mounting strips having mounting brackets that are pressure inserted through longitudinally spaced slots in the outer flanges of the studs and tracks for attaching a reinforcing mesh and encapsulated by a poured concrete panel.

9 Claims, 5 Drawing Sheets

CONCRETE STUD WALL SYSTEM

FIELD OF THE INVENTION

The present invention relates to walls systems and in particular to concrete stud walls.

BACKGROUND OF THE INVENTION

Composite steel stud and concrete walls are widely used for exterior perimeter walls systems. Therein the studs and tracks are assembled and concrete connectors attached to the studs. The stud wall is placed over a form and the concrete poured into the form thereby bonding to the connectors. When the concrete is set, the composite wall is transported to the construction site and raised into place. The concrete connectors have been primarily attached to the outer flanges of the studs with mechanical fasteners, a time consuming step of layout and installation. To avoid the need for mechanical fastening, it has been proposed to use structural shapes formed from the stud flanges. U.S. Pat. Nos. 4,602,467 and 4,885,884 to Schilger disclose longitudinal tabs punched in the flanges for use in anchoring the concrete and mounting reinforcing mesh. A similar approach is disclosed in U.S. Pat. No. 6,151,858 to Ruiz et al. wherein L-shaped tabs are formed in the flanges of the wall components. While eliminating the need for mechanically fastening the connectors, the tabs detracted from the structural strength of the components and provided limited structural interfaces for resisting lateral and longitudinal load changes.

BRIEF SUMMARY OF THE INVENTION

The present invention provides a composite concrete stud wall system overcoming the above limitations. The outer flanges of the tracks and studs of the framed wall include a longitudinal series of rectangular slots that receive a mounting clip having brackets that are press fitted into slots and interconnected by bases reinforcing the component flange. The brackets are detented at the flange and have flat upper walls for securing a reinforcing mesh. The poured concrete wall encapsulates the brackets resulting in plural load transfer connections at each bracket thereby providing improved lateral and longitudinal support under static and kinetic loading.

Accordingly, it is an object of the invention to provide an improved load bearing connection between a stud wall and a cast concrete panel in composite wall systems.

Another object is to provide an improved connector for securing a poured concrete panel to a backing wall.

A further object is to provide a concrete wall connector that is readily manufactured and easy to install.

DESCRIPTION OF THE DRAWINGS

The above and other features and advantages of the invention will become apparent upon reading the following detailed description taken in conjunction with the accompanying drawings in which.

DETAILED DESCRIPTION OF THE PREFERRED EMBODIMENT

Figure 1:
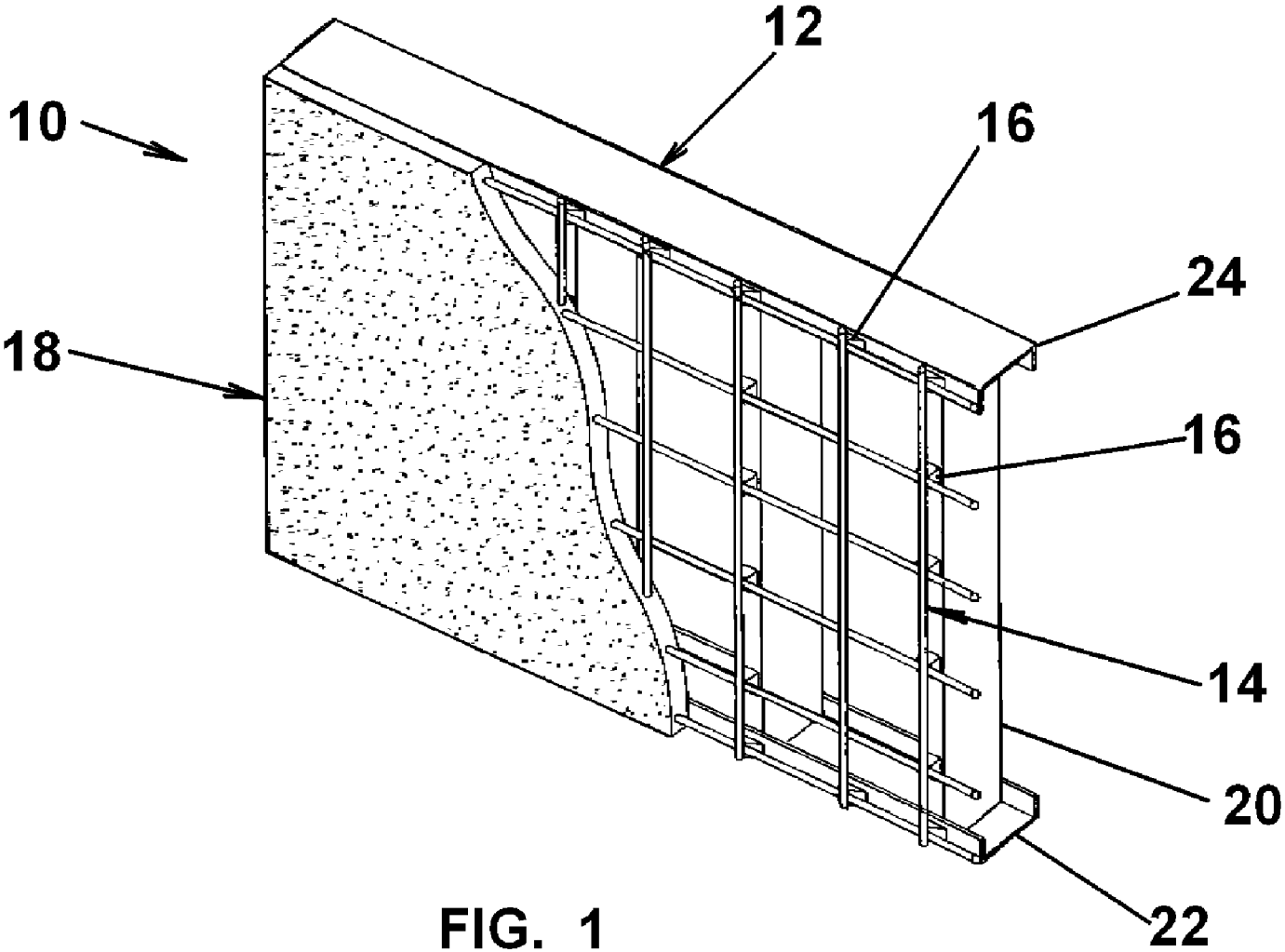
FIG. 1 is a partially sectioned perspective view of a concrete stud wall system in accordance with an embodiment of the invention.

Referring to the drawings, FIG. 1 shows a concrete stud wall system 10 in accordance with an embodiment of the invention. The stud wall system 10 comprises a preassembled stud wall 12 having a reinforcing mesh 14 attached at horizontal and vertical clip strips 16, which are embedded in a poured concrete wall panel 18.

Figure 2:
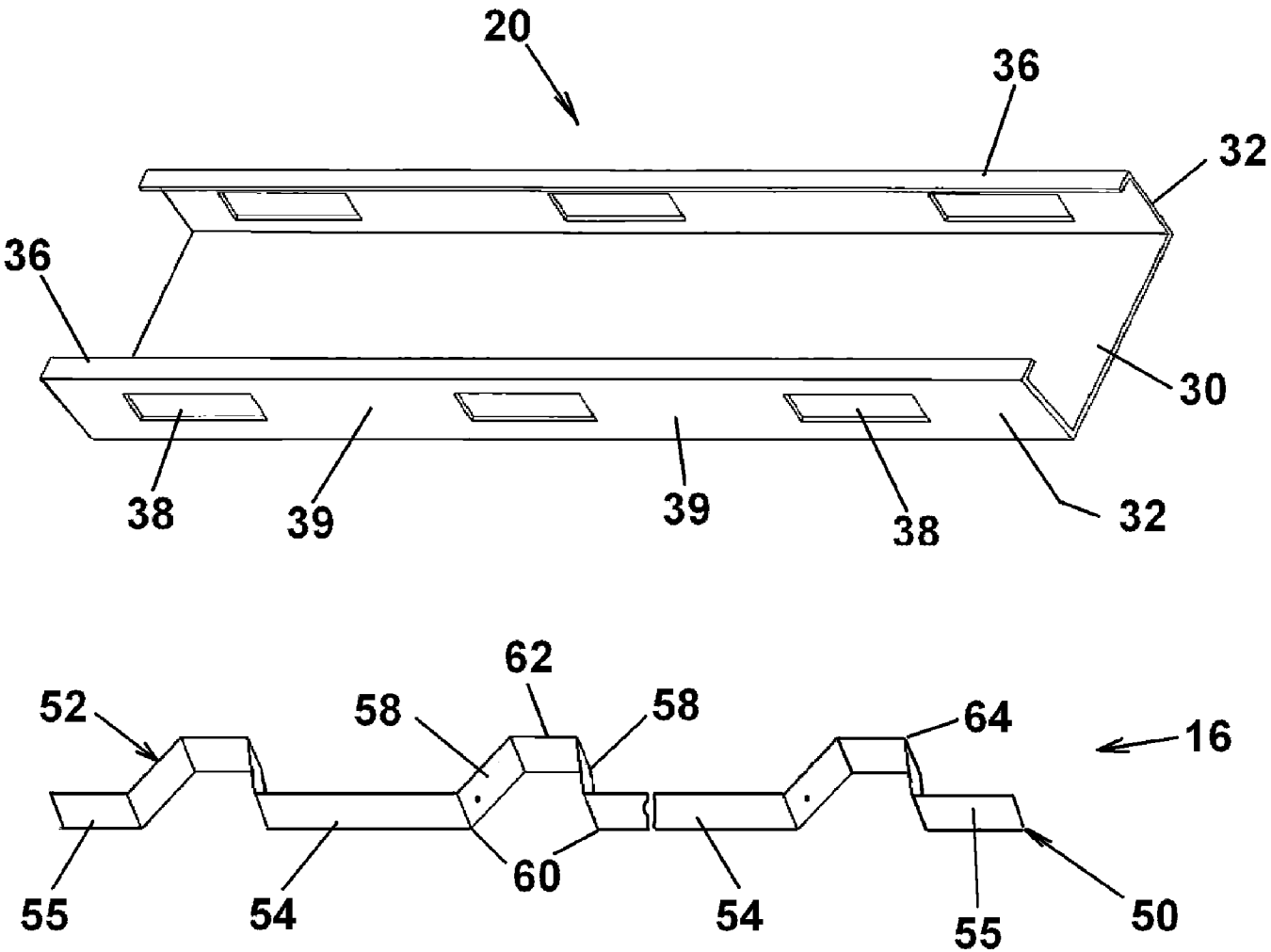
FIG. 2 is an exploded perspective view of a clip strip and the stud component prior to assembly.

The stud wall 12 is a conventionally assembled from wall components including vertical studs 20 connected at outer ends by fasteners, not shown, to a footer track 22 and a header track 24. As shown in FIG. 2, the stud 20 is of conventional C-shaped configuration and comprises a base wall 30 having longitudinal upwardly turned, laterally spaced side flanges 32, each terminating with an inwardly turned lip 36. The side flanges 32 are modified to include a longitudinal series of rectangular holes or clip slots 38 mutually spaced by center sections 39. Inasmuch as only one series is used in the wall system, for convenience of assembly both series may be preferred. The spacing of the holes is dependent on the grid of the mesh 14, a center-to-center spacing of 12 inches is typically employed. The studs 20 are also conventionally prescribed based on the wall application, a 6 inch stud of 16 ga. steel being typical.

Figure 3:
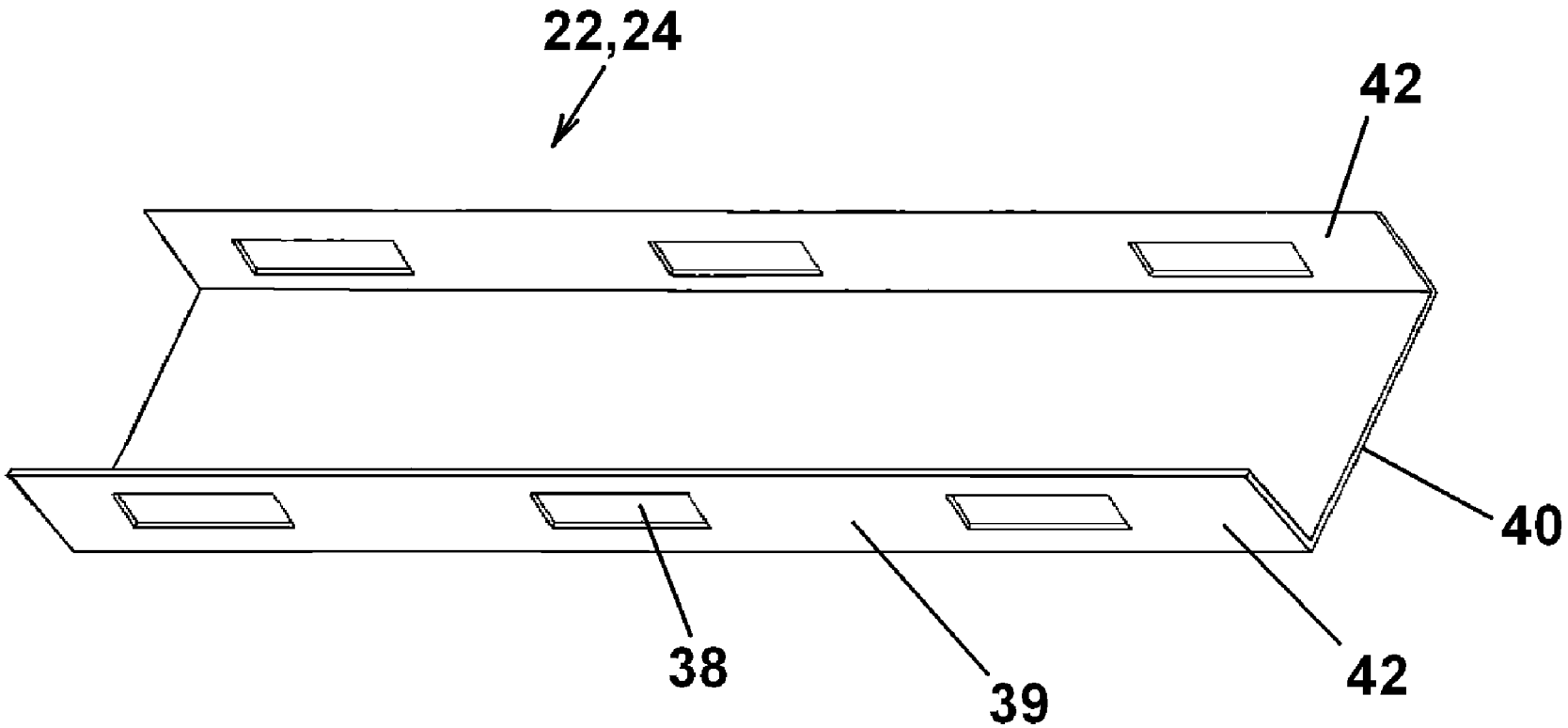
FIG. 3 is perspective view of the channel component.

As shown in FIG. 3, the tracks 22, 24 are identical, each comprising a base wall 40 and upwardly turned flanges 42 at the longitudinal edges thereof. The flanges 42 are provided with a longitudinal series of rectangular holes or clip slots 38 as described above.

Figure 4:
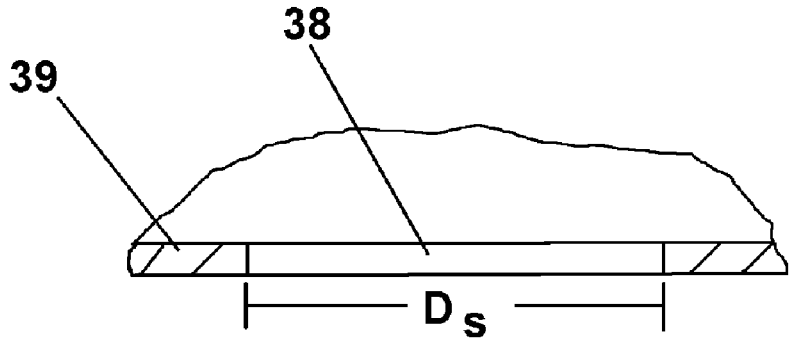
FIG. 4 is a fragmentary side view illustrating the mounting slot of the stud wall component.
Figure 5:
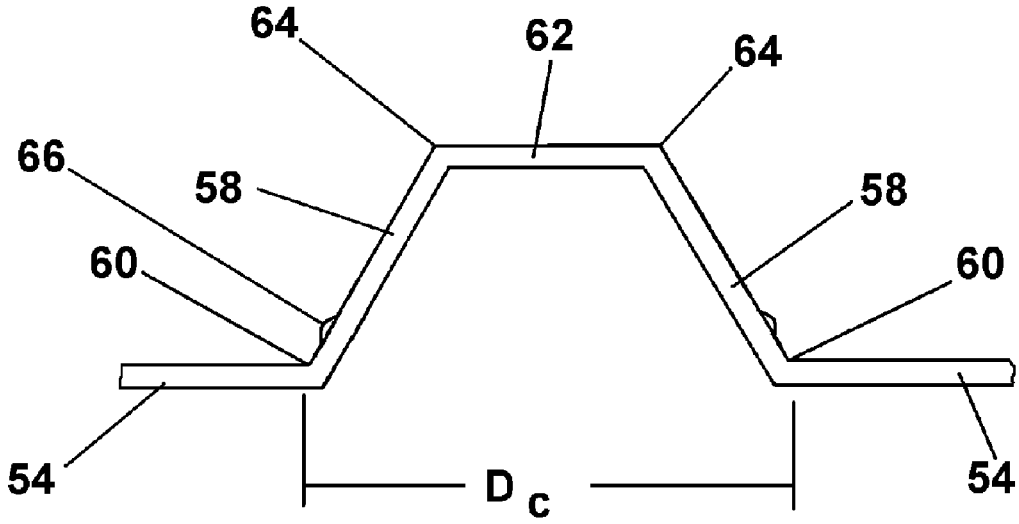
FIG. 5 is a fragmentary side view of the bracket strip prior to assembly.
Figure 6:
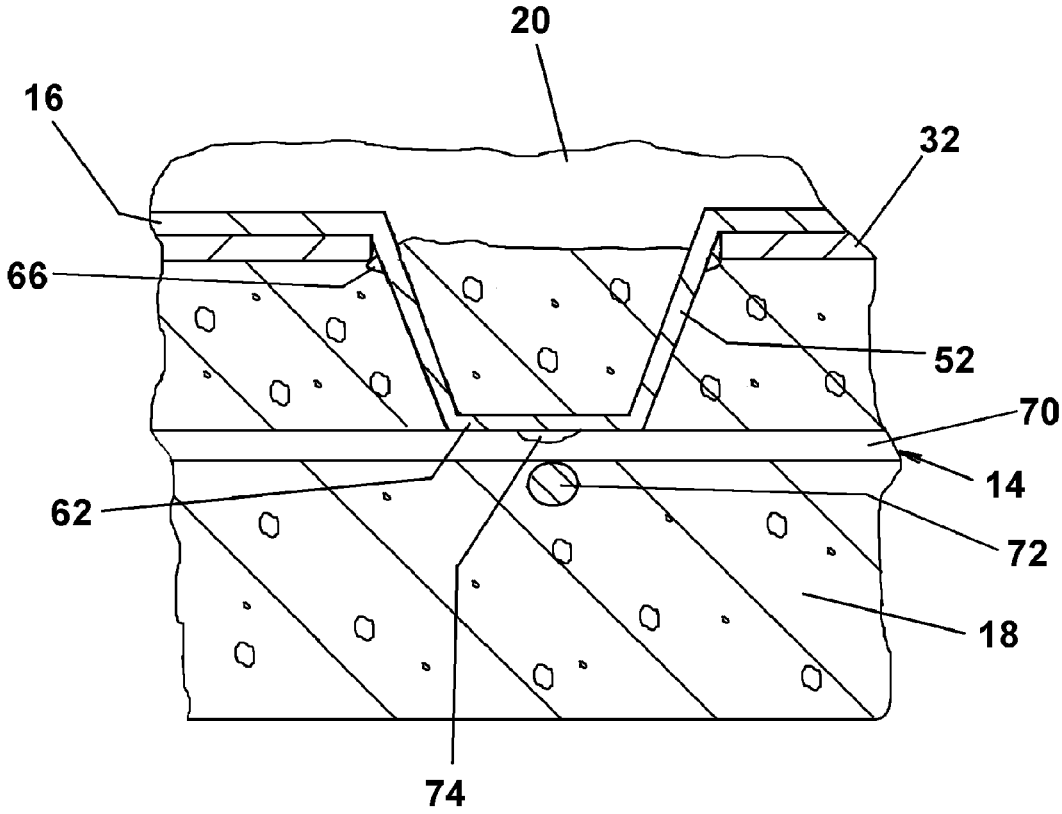
FIG. 6 is a fragmentary cross sectional view of the concrete stud wall system.

The clip strip 16 as shown in FIGS. 2 and 4 is adapted for detented press fitting into the slots 38 of the studs and tracks. The strip 16 comprises an elongated rectangular body 50 having a longitudinal series of integrally formed projecting reinforcing and mounting brackets 52 interconnected by bases 54 and longitudinally terminating at ends 55. The width of the strip 16 is slightly less than the width of the slots 38 for facilitating insertion for assembly. The base 54 has a length substantially the same as the center sections 39 between the holes 38 and overlies the center sections in assembly. The brackets 52 have an truncated inverted U-shape comprising side walls 58 upwardly inwardly converging from the base 54 at transverse lower bends 60 and interconnected to a top wall 62 parallel to the base 54 at transverse upper bends 64. Prior to assembly with the components, the included angle between the base 54 and the side walls 58 is increased to provide a spacing between the lower bends 60 slightly greater than the length of the slots 38. The side walls 58 deflect inwardly to provide a sliding fit during insertion into the slots and compressively engage the adjacent end walls at the slot to retain the strip in assembled condition. As shown in FIG. 6, retention of the strip may be further increased by providing detenting between the side walls and the flange, such as an outwardly formed detent or tab 66, which coacts with the inner edge of the end wall of the slot. Sufficient retention is provided by a spacing "$D_C$" between the bends 60 that is about ¼ to 1 inch greater than the spacing "$D_S$" between the ends of the holes 38.5. The included angle between the side walls and the base 54 is preferably in the range of about 90° to 135°, with a range of about 100° to 130°. Further, the included angle between said side walls and the bases in unassembled form is about 10° or greater than the included angle therebetween in assembled form.

For stud wall assembly, the strips are press fitted and detented into the slots 38 on the studs 20 and tracks 22, 24. Thereafter, the studs 20 are inserted between the flanges 42 of the tracks and attached by suitable conventional fasteners, such as self tapping screws. As shown in FIG. 6, the mesh 14 is attached at the intersections of the reinforcing bars 70, 72 to the top wall 62 of the brackets by tack welds 74 or twist ties. Thereafter the assembled stud wall is placed facing downwardly into a concrete form, and concrete is poured between the studs to form the wall panel 18, embedding the mesh and the brackets 52. The open shape of the brackets with the obtuse angles allowing the concrete, including aggregate, to tightly conform to the bracket walls reinforcing and immobilizing the strip.

The resulting concrete stud wall forms an improved composite for the multiple shear sections at each bracket provides plural and bidirectional load support between the stud wall and the concrete panel. The open shape of the brackets provides for complete encapsulation and effective tensile strength. The bases of the strips provides a stiffening for the flanges for increasing load strength. The top faces of the brackets provide for ready attachment of the mesh grid at controlled depths. Moreover, the strip may be applied to both the studs and the tracks without fasteners increasing the efficiency of assembly.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed is:

1. A concrete stud wall system comprising: a plurality of laterally spaced vertically extending stud members having outwardly facing outer flanges; a horizontally extending upper track member having an outer flange connected to upper ends of said outer flanges of said stud members; a horizontally extending lower track member having an outer flange connected to lower ends of the outer flanges of said stud members; a longitudinally spaced series of rectangular holes spaced by connecting sections formed in said outer flanges of said stud members and said track members, said holes having a longitudinal length and a transverse width; a plurality of stud clip strip members carried by said outer flanges of said stud members and said track members, said strip members having a longitudinal series of projecting bracket sections interconnected by base wall sections, said bracket sections having an inverted truncated U-shape including outwardly converging side walls connected by transverse outer folds at outer ends to a rectangular front wall and inner ends directly connected by transverse inner folds to said base wall sections wherein the width of said strip member is less than said transverse with of said holes, the longitudinal spacing between said inner folds at said inner ends in unassembled form being greater than said longitudinal length of said holes whereby side walls deflect upon insertion into said holes and in assembly compressively engage said outer flanges at longitudinal end surfaces of said holes, said base walls overlying, engaging and reinforcing said connecting sections of said outer flanges in assembly; a reinforcing mesh of spaced vertical and horizontal reinforcing members intersecting a nodal locations wherein said bracket sections are arrayed whereby said front walls engage said nodal location; means for connecting said reinforcing members to said bracket sections; and a cast concrete panel encapsulating said bracket sections and said mesh for structural attachment at said outer flanges.

2. A wall system comprising: a plurality of laterally spaced vertically extending stud members having outwardly facing outer flanges; a horizontally extending upper track member having an outer flange connected to upper ends of said outer flanges of said stud members; a horizontally extending lower track member having an outer flange connected to lower ends of the outer flanges of said stud members; a longitudinally spaced series of rectangular holes spaced by connecting sections formed in said outer flanges of said stud members and; a plurality of stud clip strip members formed of an elongated planar material carried by said outer flanges, said strip members having projecting bracket sections extending through said holes and interconnected by base wall sections engaging said connecting sections of said outer flanges, said bracket sections having transverse rectangular outwardly converging side walls connected at outer ends to a transverse rectangular front wall and inner ends directly connected to said base wall sections, the longitudinal spacing between said inner ends prior to assembly being greater that the length of said holes whereby side walls deflect upon insertion into said holes and in assembly compressively engage said outer flanges at longitudinal end surfaces of said holes, said base walls overlying and reinforcing said connecting sections of said outer flanges in assembly.

3. The wall system as recited in claim 2 further including a reinforcing mesh of spaced vertical and horizontal reinforcing members wherein said bracket sections are arrayed whereby said front walls engage said reinforcing members and means for connecting said reinforcing members to said bracket sections.

4. The wall system as recited in claim 3 including detent means operatively engaging said outer flanges with said side walls of said bracket sections to maintain said clip strips in assembled condition on said outer flanges.

5. The wall system as recited in claim 4 including a cast concrete panel encapsulating said bracket sections and said mesh for structural attachment at said outer flanges.

6. The wall system as recited in claim 5 wherein said bracket sections have a generally truncated inverted U-shape and said side walls have an included angle with said connecting sections in unassembled form in the range of about 90° to 135°.

7. The wall system as recited in claim 6 wherein said included angled in said unassembled form is in the range of about 100° to 130°.

8. The wall system as recited in claim 7 wherein said included angle between said side walls and said connecting sections in unassembled form is about 10° or greater than the included angle therebetween in assembled form.

9. The wall system as recited in claim 6 wherein said clip strip has a width providing a sliding fit with said holes for assembly.

* * * * *